US007926683B2

(12) United States Patent
Müller

(10) Patent No.: US 7,926,683 B2
(45) Date of Patent: Apr. 19, 2011

(54) DEVICE FOR CLOCKED DISPENSING OF PORTIONS OF A PASTY COMPOUND

(75) Inventor: Heinz Müller, Gelterkinden (CH)

(73) Assignee: Robatech AG, Muri (CH)

( * ) Notice: Subject to any disclaimer, the term of this patent is extended or adjusted under 35 U.S.C. 154(b) by 541 days.

(21) Appl. No.: 12/031,351

(22) Filed: Feb. 14, 2008

(65) Prior Publication Data

US 2008/0196837 A1 Aug. 21, 2008

(30) Foreign Application Priority Data

Feb. 14, 2007 (EP) ..... 07102361

(51) Int. Cl.
*B67D 3/00* (2006.01)

(52) U.S. Cl. ..... 222/485; 118/410

(58) Field of Classification Search ..... 222/484–488, 222/478; 118/314, 315, 307, 410–419; 156/578
See application file for complete search history.

(56) References Cited

U.S. PATENT DOCUMENTS

| | | | | |
|---|---|---|---|---|
| 2,002,242 A | | 5/1935 | Greene | |
| 3,429,642 A | * | 2/1969 | Underwood | 401/16 |
| 3,709,432 A | * | 1/1973 | Robertson | 239/4 |
| 5,264,036 A | * | 11/1993 | Haas et al. | 118/315 |
| 5,286,182 A | * | 2/1994 | Maeda et al. | 425/72.1 |
| 5,334,247 A | * | 8/1994 | Columbus et al. | 118/411 |
| 5,750,159 A | * | 5/1998 | Delmore et al. | 425/190 |
| 7,507,295 B2 | * | 3/2009 | Ganzer et al. | 118/313 |
| 2006/0201630 A1 | | 9/2006 | Puffe et al. | |
| 2006/0222322 A1 | | 10/2006 | Levitan | |

FOREIGN PATENT DOCUMENTS

| | | | |
|---|---|---|---|
| DE | 94 12 935 | U1 | 10/1994 |
| DE | 203 03 182 | U1 | 7/2003 |
| DE | 20 2006 014743 | U1 | 11/2006 |

* cited by examiner

*Primary Examiner* — Lien T Ngo
(74) *Attorney, Agent, or Firm* — Browdy and Neimark, PLLC

(57) ABSTRACT

A device for clocked dispensing of portions of a pasty compound, having a nozzle body, which has a vertical main channel terminated on top and a feed channel for feeding the pasty compound. The nozzle body comprises a multiplicity of distribution channels running transversely to the main channel, each having an entry cross-section on the main channel and each having an exit cross-section, and a dispensing area, into which the exit cross-sections of the distribution channels open out. The distribution channels have a distribution channel area rising in the flow direction of the pasty compound.

12 Claims, 4 Drawing Sheets

DEVICE FOR CLOCKED DISPENSING OF PORTIONS OF A PASTY COMPOUND

RELATED APPLICATION DATA

The present application claims the priority of the earlier EP application No: 07 102 361.8 filed on the 14 Feb. 2007.

BACKGROUND OF THE INVENTION

Field of the Invention

The invention regards a device for sequentially dispensing portions of pasty compounds according to the preamble of Claim 1.

This concerns, for example, but not exclusively, dispensing a pasty compound such as an adhesive clocked respectively using identical or varying application periods and interruptions onto an object or a sequence of objects, in order to deposit the pasty compound thereon preferably in interspaces with a strip-shaped or planar application.

The labeling of containers such as bottles, cans, or other formations is cited as one of numerous possible applications, but without restrictive effect on the invention. In this connection, a sequence of the bottles or cans to be labeled is led past a labeling station, preferably in vertical orientation, and each bottle or can is provided with a label. For this purpose, a first edge strip of a label is fixed along a vertical area on the bottle or can using an adhesive, which is typically only applied punctually or sprayed on. A planar or strip application over the label height of an adhesive is then deposited on a second edge strip of the label, which is opposite to the first edge strip. The label is led around the bottle or can by a suitable relative movement between the bottle or can and a label dispenser of the labeling station and applied thereto in such a way that the second edge strip comes to lie over the first edge strip.

Labeling stations of this type having nozzle bodies for dispensing adhesives in form of pasty compounds are known. However, they are afflicted with various disadvantages.

A first disadvantage of typical labeling stations is, that the adaptation of the labeling stations respectively the nozzle bodies for applying labels of various heights is circumstantial. Namely, a height-adapted nozzle body is conventionally used for each label size. If labels of other heights are to be processed, the nozzle body must be replaced, what may only occur by performing complex mounting and adjustment procedures. There are also solutions known, at which the adaptation to taller or less taller labels occurs in that a part of the nozzles are replaced by blank nozzles on a nozzle body. Also this approach is time-consuming.

To improve the changeover, a slotted nozzle with nozzle body can be used, in whose main channel a piston is arranged displaceable. The main channel runs parallel to the oblong slot of the slotted nozzle. Such a piston covers respectively a part of the slotted nozzle, so that the corresponding part is inactive respectively no longer operative. However, a main channel having a comparatively large diameter is required for such a configuration, because the main channel must distribute the pasty compound in such a way, that it exits uniformly through the slot of the slotted nozzle.

Height-adaptable nozzle bodies may also be implemented by providing instead of or in addition to a piston a vane, which projects through the dispensing area respectively slot of a slotted nozzle and may be displaced therein for the adjustability of the nozzle. Because such a vane requires for reasons of strength a specific minimum wall thickness, a comparative wide dispensing area respectively slot must be provided. The danger thus increases, that air flows into the main channel during interruptions of the dispensing of the compound. Furthermore, a wide dispensing gap results in higher consumption of pasty compound and relative thick layers of the applied pasty compound, what is generally not desired.

A special disadvantage of conventional nozzle bodies is, that ambient air enters the main channel between the application procedures of the pasty compound, in particular if a large main channel having a piston is provided, and thus parts of the compound exit from the channel system. This is among other things all the more the case, the larger the cross-section of the main channel is, and it may have the result, that the pasty compound dispensed during the next clock does not reach to an application surface in the desired configuration respectively without forming a continuous bead. This is because after a part of the compound exits or runs out, the main channel must first be filled with compound again before pasty compound may be dispensed again uniformly. This latter problem is tightened by the height-adaptable nozzle bodies, because a main channel having a relative large diameter is required therein.

SUMMARY OF THE INVENTION

Object of the invention is to provide a device for the clocked dispensing of a pasty compound of the type cited at the beginning, whereas the pasty compound to be dispensed should form an application layer which is as continuous as possible, in the meaning of uniform, even after clock interruptions or other pauses. This application layer may be planar or linear and is in particular to ensure beads of low height and thus a thrifty consumption of pasty compound.

The solution of this object is effected at a device of the type cited at the beginning by the features of independent Claim 1.

Preferred embodiments of the invention are defined by the dependent claims.

The novel device comprises a nozzle body having at least one feed channel, having a main channel, having a multiplicity of distribution channels, and having a dispensing area extending over the length of the nozzle body, whereas these four elements of the nozzle body are passed through during the dispensing of portions of the pasty compound in the order just cited. The at least one feed channel is fed with pasty compound and opens out into the main channel, namely preferably into its lowermost area, i.e., below the distribution channels. The main channel is arranged at least approximately vertically. The distribution channels open out into the shared exit area, they have entry cross-sections which lie in the walls of the main channel, as well as exit cross-sections in the dispensing area. The dispensing area is delimited by the nozzle body.

According to the invention, each distribution channel has a channel area which rises in the flow direction of the dispensed pasty compound. This prevents ambient air from reaching the main channel quasi backwards through the distribution channels during interruptions of the dispensing of the pasty compound, or, in other words, it prevents the main channel from drawing in air. In this way it can be achieved, that no compound runs out and thus upon resumption of the dispensing of pasty compound in the following clock respectively after an interruption, pasty compound always reaches the application surface in a continuous and uniform configuration.

In a preferred exemplary embodiment, the distribution channels run linear or curved, but anyway so, that the exit cross-section of each distribution channel is arranged above the entry cross-section of the same distribution channel, whereby the rising channel area is formed.

In another preferred exemplary embodiment, each distribution channel has a siphon-like curved area, in which the rising channel area is arranged.

Continuous beads are particularly to be formed even if the nozzle body has in its main channel an height-adaptable piston, using which the device may be adapted easily for dispensing beads of various height.

The nozzle body preferably essentially consists of a first nozzle partial body and a second nozzle partial body. Each of the nozzle partial bodies has a contact surface, whereas the two contact surfaces butt tightly against each other in the assembled state of the device. The contact surfaces are preferably vertical and even. Each of the nozzle partial bodies further has an edge surface, whereas the edge surfaces are not coherent and do not butt against each other, but delimitate the vertical channels and the dispensing area.

In particular for the simplification of the production and the assembly of the nozzle body, the distribution channels are practically arranged always only in the first nozzle partial body, namely on a first surface, to which a second surface on the second nozzle partial body is faced. These two surfaces are part of the contact surfaces with which the nozzle partial bodies butt against each other, whereas the distribution channels interrupt the contact surfaces. The second of these surfaces, i.e., the surface which is arranged on the second nozzle partial body, forms a cover surface for the distribution channels. This cover surface is preferably even, but may also be accomplished differently. The base surface of each distribution channel on the first nozzle partial body facing the cover surface on the second nozzle partial body forms quasi the basically vertical oriented channel base.

For producing a continuous dispense of the pasty compound, it is advantageous, if the cross-section of the feed channel is dimensioned at least as large as the sum of the cross-sections of the distribution channels.

It has proven as favorable, to design the distribution channels in such a way that their depth, i.e., their dimension between the channel base of the first nozzle partial body on one hand and the cover surface of the second nozzle partial body on the other hand, is in the area of the entry cross-sections greater than in the area of the exit cross-sections. In another embodiment, the cross-section remains essentially equal.

Each distribution channel is preferably divided by a dam originating from its channel base into an upper partial channel and a lower partial channel. The dam does not extend up to the cover surface of the distribution channel, so that the two partial channels of the same distribution channel may communicate with each other.

This dam may widen toward the exit cross-section in such a way that the partial channels run in the exit-side area distant from each other, whereas they preferably still communicate.

The exit cross-section of the upper partial channel of a certain distribution channel may be arranged essentially adjoining the lower partial channel of the neighboring distribution channel lying above. Accordingly, the exit cross-section of the lower partial channel of the certain distribution channel is then arranged essentially adjoining the upper partial channel of the neighboring distribution channel lying underneath.

The distribution channels preferably do not run linearly, but form for example a very flat Z having rounded corners. The picture of the distribution channels resulting by this, when looking on the contact surface of the first nozzle partial body, is from far approximately that of a comb having wavy teeth or a rake having wavy tines. However, viewed more precisely, the distribution channels rather form a branched or slightly cross-linked system in regard to their ability to have flow through them, for example, like the river arms of a delta of a river mouth, admittedly having a very regular configuration of the individual river arms.

As already mentioned, the main channel is oriented at least approximately vertically and preferably has a piston arranged displaceably in the main channel, whereby the position of the piston determines the number and if so, the position of the distribution channels being flowed through by the pasty compound.

BRIEF DESCRIPTIONS OF THE DRAWINGS

Further details and advantages of the invention are described in detail in the following on the basis of examples and with reference to the drawing.

DETAILED DESCRIPTION OF THE PREFERRED EMBODIMENTS

Figure 1A:
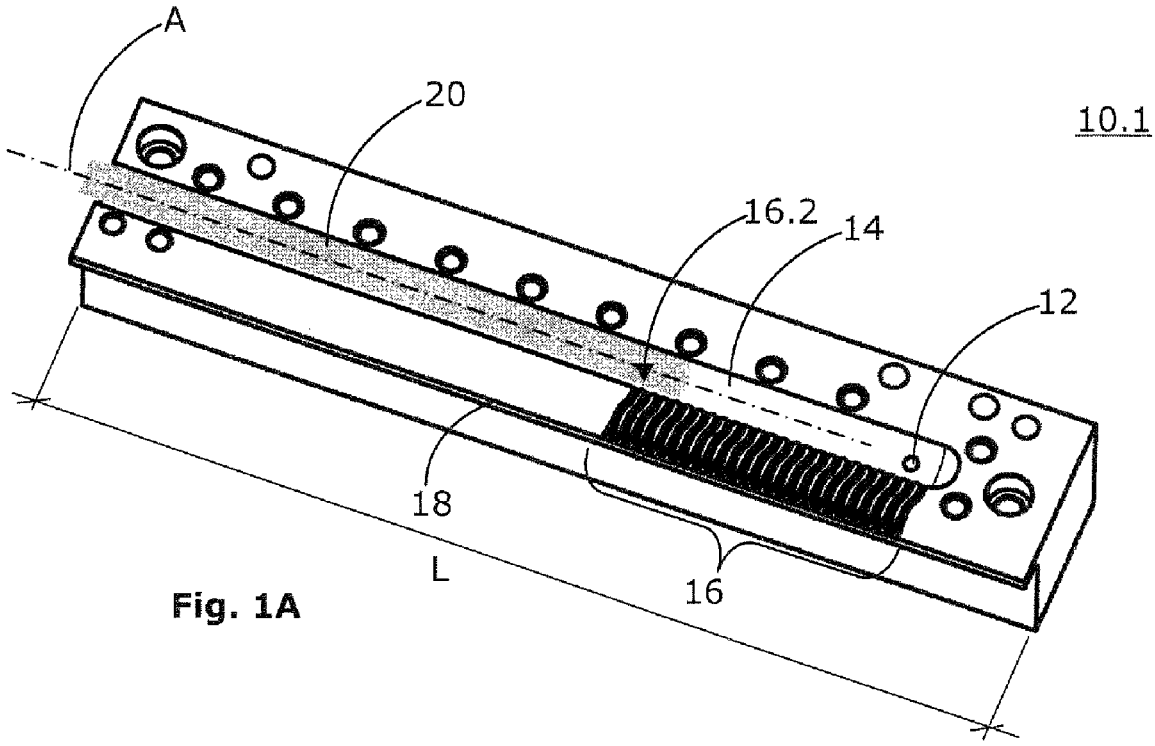
FIG. 1A shows an exemplary embodiment of a first nozzle partial body of a device according to the invention, in a perspective illustration.
Figure 1B:
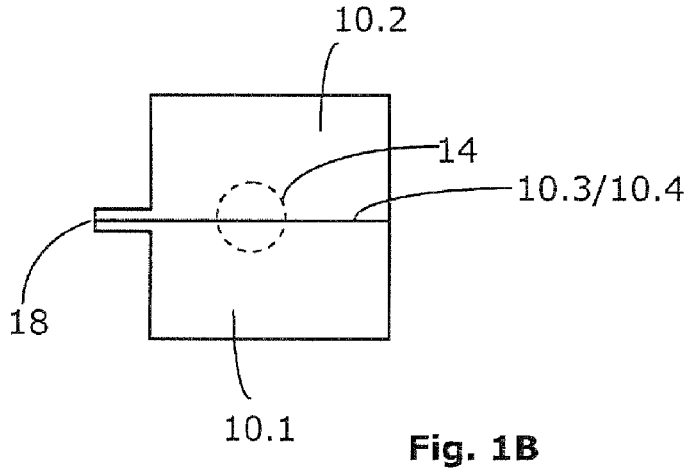
FIG. 1B shows a schematic side view of a nozzle according to the invention.
Figure 2:
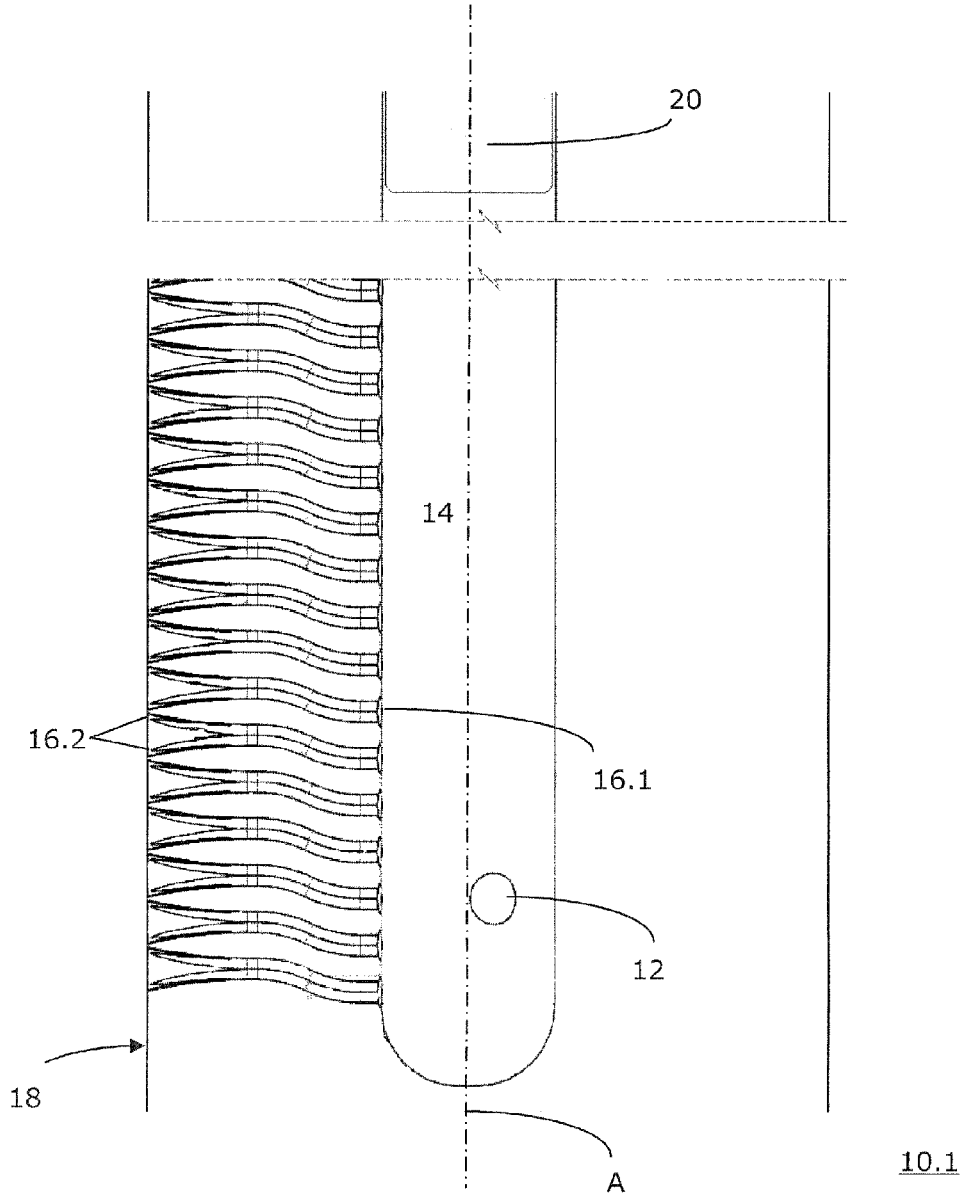
FIG. 2 shows the first nozzle partial body shown in FIG. 1A, looking toward the contact surface.

FIGS. 1A and 2 show a first nozzle partial body 10.1 of a device 10 according to the invention. The device 10 according to the invention comprises further a second nozzle partial body 10.2, which is only in FIG. 1B and FIG. 5 visible.

The nozzle partial body 10.1 is oblong and has a longitudinal axis A, which is oriented at least approximately vertically in the mounted and/or usage-ready state.

The nozzle partial body 10.1 has a feed channel 12, a main channel 14, a multiplicity of distribution channels 16, and a dispensing area 18.

The feed channel 12, which could be arranged also in the second nozzle partial body 10.2, opens out into the lower area of the main channel 14.

The oblong main channel 14 is cylindrical in the present exemplary embodiment, and its longitudinal axis is coincident with the longitudinal axis A of the first nozzle partial body 10.1. The main channel 14 is terminated tightly on top, either by a fixed configuration or, as shown in FIG. 2, by a sealing piston 20 longitudinally displaceable in the main channel.

The distribution channels 16 have entry cross-sections 16.1, which lie in the lateral forming a cylindrical mantle wall 14.1 of the main channel 14. Furthermore, the distribution channels 16 have exit cross-sections 16.2.

In the exemplary embodiment according to FIG. 1A, the nozzle partial body 10.1 has distribution channels 16 only over a part of its length L, whereas the entry cross-sections 16.1 of a part of these distribution channels 16 are closed by the piston 20.

A device 10 according to the invention, in the present case referred to as a nozzle, is shown in the assembled state in FIG. 1B. It may be seen on the basis of this figure that the nozzle 10 is assembled of the first nozzle partial body 10.1 and the second nozzle partial body 10.2. The position of the main channel 14 is indicated by a dashed circle.

Figure 3A:
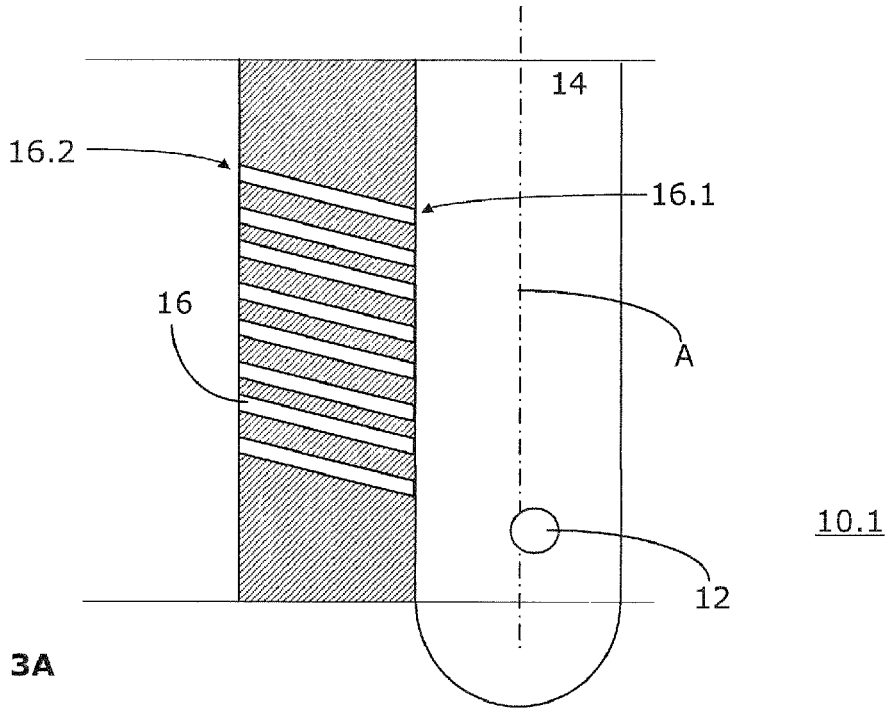
FIG. 3A shows a first exemplary embodiment of the distribution channel, in which the entire distribution channel forms a rising channel area.
Figure 3B:
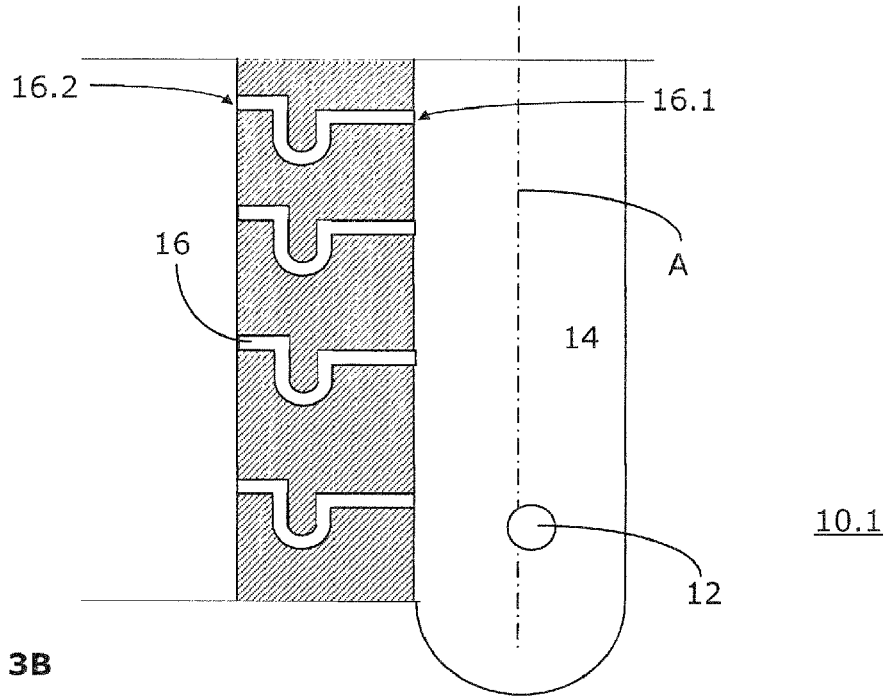
FIG. 3B shows a second exemplary embodiment of the distribution channel, in which a siphon-like curved area contains a rising channel area.

According to FIG. 3A, the course of the distribution channels 16 is designed in the present exemplary embodiment in such a way that the exit cross-sections 16.2 lie on a higher level than the entry cross-sections 16.1. This prevents air from reaching the main channel 14 during an interruption of the dispensing of the pasty compound. In the exemplary embodiment shown in FIGS. 1A and 2, the distribution channels 16 do not run along a straight line, but in the form of a very flat Z having strongly rounded corners. In order to prevent ambient air from reaching the main channel 14 through the distribution channels 16, the distribution channels 16 may be linear according to FIG. 3A or also have a siphon-like area according to FIG. 3B. It is essential, that the distribution channels 16, viewed in the flow direction of the pasty compound, have at least one rising channel area.

A dispensing area 18 comprises the exit cross-sections 16.2 of the distribution channels 16. The dispensing area 18 may additionally be expanded by a dispensing gap into which the distribution channels 16 open out (not shown).

Figure 4:
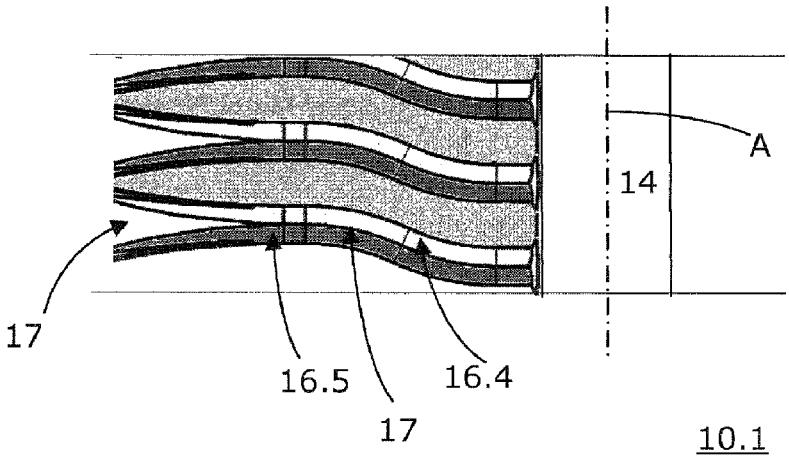
FIG. 4 shows several neighboring distribution channels of the first nozzle partial body according to FIG. 1A to 2, in a diagram.
Figure 5:
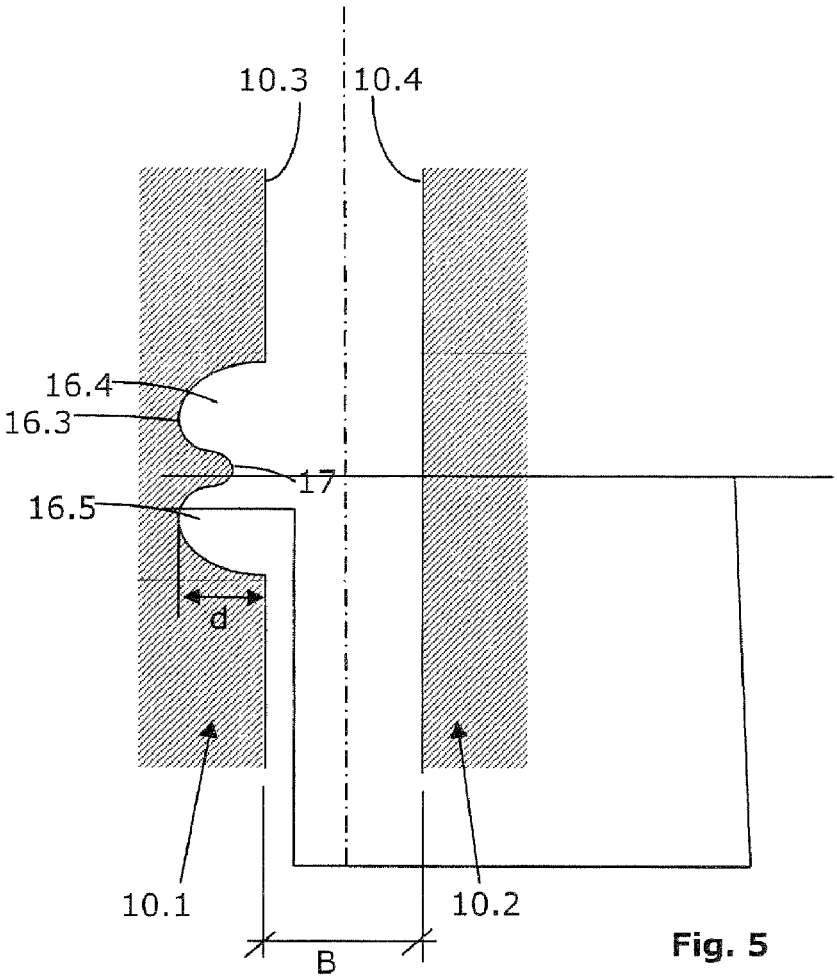
FIG. 5 shows the first nozzle partial body shown in FIGS. 1A and 2 together with an associated second nozzle partial body, partially, in a section parallel to the longitudinal axis of the device.

FIG. 4 and FIG. 5 show details from FIG. 1A, in an illustration enlarged in relation to FIG. 1A.

FIG. 4 shows several of the distribution channels 16 in a diagram, wherein each distribution channel 16 is divided into an upper partial channel 16.4 and a lower partial channel 16.5.

FIG. 5 shows the first nozzle partial body 10.1 partially in a section parallel to the longitudinal axis A, with one of the distribution channels 16 and the second nozzle partial body 10.2. In FIG. 5, the partial nozzle bodies 10.1, 10.2 are shown having a mutual distance B for the sake of clarity, while they actually butt against one another tightly along contact surfaces 10.3, 10.4 in the assembled state (i.e., in the assembled state B=0). The distribution channel 16 shown in FIG. 5 extends, as is typical for all distribution channels, between a channel base 16.3 and the contact surface 10.3. A dam 17 divides the partial channel 16 into an upper partial channel 16.4 and a lower partial channel 16.5. The dimension of the dam 17 perpendicular to the contact surfaces 10.3, 10.4 (i.e., the height of the dam 17) is less than the depth d of the distribution channel 16, so that the upper partial channel 16.4 and the lower partial channel 16.5 communicate.

As shown in FIG. 4, the width of the dam 17 may increase along the distribution channel 16, the partial channels 16.4 and 16.5 still being able to communicate, however.

As may also be seen from FIG. 4, the upper partial channel 16.4 of each distribution channel 16 approaches the lower partial channel of the adjacent distribution channel lying above, correspondingly, the lower partial channel of each distribution channel 16 approaches the upper partial channel of the adjacent distribution channel lying underneath.

The dimension of the distribution channels 16, i.e., their depth, perpendicular to the contact surfaces 10.3, 10.4 is greater in the area of the entry cross-sections 16.1 than in the area of the exit cross-sections 16.2, i.e., the distribution channels 16 are deeper in the area of the entry cross-sections 16.1 than in the area of the exit cross-sections 16.2, wherein their depth is to be understood as an essentially horizontal dimension. In the area of the entry cross-sections 16.1, the distribution channels 16 may be for example approximately 0.2 mm deep, and for example approximately 0.15 mm deep in the area of the exit cross-sections, whereas these dimension specifications are cited expressly only as examples and without restricting effect.

The branched arrangement of the distribution channels 16 has the result, that the pasty compound, as intended, may be dispensed in portions coherently as a bead in any case along a line or surface, because the object on which the compound is to be dispensed moves past the nozzle. This movement occurs perpendicularly to the longitudinal axis A of the nozzle.

What is claimed is:

1. A device for clocked dispensing of portions of a pasty compound, comprising a nozzle body having one at least approximately vertical main channel, terminated on top, having a feed channel for feeding the pasty compound, said feed channel opening out into the main channel, wherein the nozzle body comprises a multiplicity of distribution channels, running transversely to the main channel, each having an entry cross-section on the main channel and each having an exit cross-section, and a dispensing area, into which the exit cross-sections of the distribution channels open out, wherein the distribution channels have at least one distribution channel area rising in the flow direction of the pasty compound so that ambient air is prevented from reaching the main channel through the distribution channels during interruptions of the dispensing of the pasty compound.

2. The device according to claim 1, wherein the exit cross-sections of the distribution channels are arranged above the associated entry cross-sections, in order to form the rising distribution channel area.

3. The device according to claim 1, wherein the distribution channels comprise a siphon-like running area having the rising distribution channel area.

4. The device according to claim 1, wherein the entry cross-sections of the distribution channels have channel cross-sections which are deeper than the channel cross-sections of the exit cross-sections.

5. The device according to claim 1, wherein each distribution channel is divided over a part of its channel depth into an upper partial channel and a lower partial channel by a dam originating from a channel base of the distribution channel in such a way that the partial channels communicate.

6. The device according to claim 5, wherein the dam widens toward the exit cross-section in such a way that the partial channels of a distribution channel run in their exit-side area distant from each other, whereas they preferably communicate.

7. The device according to claim 6, wherein the exit cross-section of the upper partial channel of a middle distribution channel is arranged essentially adjoining the lower partial channel of the adjacent upper distribution channel.

8. The device according to claim 1, wherein the mouth of the at least one feed channel lies in the lower area of the main channel, the feed channel preferably being arranged in such a way that the main channel is always flushed through and thus has no zones in which the pasty compound is stuck.

9. The device according to claim 1, wherein the nozzle body is essentially assembled of a first nozzle partial body and a second nozzle partial body, wherein the two nozzle partial bodies butt against each other tightly on at least approximately vertical contact surfaces and have edge surfaces which delimit the dispensing area (18).

10. The device according to claim 9, wherein the distribution channels are arranged in the first nozzle partial body (10.1).

11. The device according to claim 1, wherein it has a piston, which is arranged displaceable and sealing in the main channel of the nozzle body, by which said piston the entry cross-sections of a determinable number of the distribution channels is coverable, in order to inactivate the distribution channels originating from these entry cross-sections.

12. A device for clocked dispensing of portions of a pasty compound, comprising a nozzle body having one at least approximately vertical main channel, terminated on top, having a feed channel for feeding the pasty compound, said feed channel opening out into the main channel, wherein the nozzle body comprises a multiplicity of generally horizontal distribution channels, running transversely to the main channel, each having an entry cross-section on the main channel and each having an exit cross-section, and a dispensing area, into which the exit cross-sections of the distribution channels open out, wherein the distribution channels comprise means for preventing ambient air from reaching the main channel through the distribution channels during interruptions in dispensing of the pasty compound, said means comprising at least one distribution channel area rising in the flow direction of the pasty compound.

* * * * *